US006913083B2

(12) United States Patent
Smith

(10) Patent No.: US 6,913,083 B2
(45) **Date of Patent: *Jul. 5, 2005**

(54) METHOD AND APPARATUS TO MONITOR, CONTROL AND LOG SUBSEA OIL AND GAS WELLS

(75) Inventor: David Randolph Smith, College Station, TX (US)

(73) Assignee: Sensor Highway Limited, Southampton (GB)

( * ) Notice: Subject to any disclaimer, the term of this patent is extended or adjusted under 35 U.S.C. 154(b) by 0 days.

This patent is subject to a terminal disclaimer.

(21) Appl. No.: 10/633,045

(22) Filed: Aug. 1, 2003

(65) Prior Publication Data

US 2004/0020653 A1 Feb. 5, 2004

Related U.S. Application Data

(63) Continuation of application No. 10/064,407, filed on Jul. 10, 2002, now Pat. No. 6,640,900.

(60) Provisional application No. 60/305,020, filed on Jul. 12, 2001.

(51) Int. Cl.[7] ..... E21B 29/12

(52) U.S. Cl. ..... 166/336; 166/344; 166/97.5; 340/855.1

(58) Field of Search ..... 166/75.15, 88.4, 166/154, 250.11, 242.3, 336, 335, 66, 97.5, 344; 340/855.1, 854.9, 853.1

(56) References Cited

U.S. PATENT DOCUMENTS 3,026,940 A * 3/1962 Spitz ..... 166/60
3,347,319 A * 10/1967 Littlejohn ..... 166/242.3
3,489,219 A * 1/1970 Higgins ..... 166/253.1
3,612,177 A * 10/1971 Gassett et al. ..... 166/337

(Continued)

*Primary Examiner*—Thomas B. Will
*Assistant Examiner*—Thomas A Beach
(74) *Attorney, Agent, or Firm*—Wayne I. Kanak; Jaime A. Castaño

(57) ABSTRACT

A method and apparatus for logging, controlling, or monitoring a subsea well or group of wells through a path not within production tubing. Preferred embodiments allow logging tools, wire rope, optic fibers, electrical cables, monitoring and measuring instruments and other items known to those skilled in the art of oil and gas production to be disposed into the well without interfering with the flow path through the production string. A further preferred embodiment includes the mooring or tethering of an instrument pod over the subsea well. The instrument pod is designed to provide on-board data storage, data processing, data receiving, and data transmission equipment, such that data from the well can be transmitted back to a receiving network where the data may be stored and processed into useful information for reservoir operators.

32 Claims, 3 Drawing Sheets

U.S. PATENT DOCUMENTS

RE27,745 E * 8/1973 Brooks et al. ..... 166/336
4,052,703 A * 10/1977 Collins et al. ..... 714/2
4,191,250 A * 3/1980 Messenger ..... 166/253.1
4,480,690 A * 11/1984 Vann ..... 166/250.07
4,775,009 A * 10/1988 Wittrisch et al. ..... 166/250.11
4,940,094 A * 7/1990 Lessi et al. ..... 166/373
5,163,321 A * 11/1992 Perales ..... 73/152.52
5,303,773 A * 4/1994 Czernichow et al. ..... 166/66
5,318,129 A * 6/1994 Wittrisch ..... 166/336
5,381,865 A * 1/1995 Blandford ..... 166/344
5,503,225 A * 4/1996 Withers ..... 166/250.1
5,517,024 A * 5/1996 Mullins et al. ..... 250/254
5,524,709 A * 6/1996 Withers ..... 166/250.1
5,626,192 A * 5/1997 Connell et al. ..... 166/255.1
5,884,715 A * 3/1999 Reddoch ..... 175/66
5,992,250 A * 11/1999 Kluth et al. ..... 73/866.5
6,026,897 A * 2/2000 Pringle et al. ..... 166/65.1
6,026,900 A * 2/2000 Keller ..... 166/250.01
6,070,663 A * 6/2000 Cernocky et al. ..... 166/272.3
6,125,935 A * 10/2000 Shahin, Jr. ..... 166/250.14
6,173,788 B1 * 1/2001 Lembcke et al. ..... 166/387
6,268,911 B1 * 7/2001 Tubel et al. ..... 356/72
6,360,820 B1 * 3/2002 Laborde et al. ..... 166/66
6,364,021 B1 * 4/2002 Coats ..... 166/350
6,437,326 B1 * 8/2002 Yamate et al. ..... 250/269.1
6,443,228 B1 * 9/2002 Aronstam et al. ..... 166/250.11
6,480,000 B1 * 11/2002 Kong et al. ..... 324/338
6,531,694 B2 * 3/2003 Tubel et al. ..... 250/227.14
6,532,839 B1 * 3/2003 Kluth et al. ..... 73/866.5
6,640,900 B2 * 11/2003 Smith ..... 166/336
6,751,556 B2 * 6/2004 Schroeder et al. ..... 702/6
6,758,271 B1 * 7/2004 Smith ..... 166/250.1
6,772,840 B2 * 8/2004 Headworth ..... 166/302

* cited by examiner

METHOD AND APPARATUS TO MONITOR, CONTROL AND LOG SUBSEA OIL AND GAS WELLS

CROSS-REFERENCE

This application is a continuation of U.S. application Ser. No. 10/064,407 filed on 10 Jul. 2002, now U.S. Pat. No. 6,640,900, which claims priority to U.S. Provisional Application No. 60/305,020 filed 12 Jul. 2001.

BACKROUND OF INVENTION

1. Field of the Invention

The present invention is directed to methods and apparatus for logging and permanently monitoring subsea oil, gas, and injection wells; specifically to deploying photonic, electromagnetic or hydraulic conduits in an alternative path adjacent the production tubing in said wells.

2. Description of the Prior Art

Subsea wells are broadly defined as wells that do not provide fixed access from the surface of the sea. Subsea wells have wellheads located at or very near the sea floor and produce into subsea pipelines or provide access only through long subsea umbilical cables to distant locations. Traditional offshore wells located on offshore platforms have wellheads located on a platform at or above the sea surface.

Fluid flowing from subsea wells proceeds out of the wellbore from one or more producing zones, through a system of continuous conduits, subsea wellheads, subsea flow lines and subsea pipelines to a surface production and storage facilities. Often, the well products have to travel many miles from the subsea well head to such storage facilities As oil and gas becomes more and more difficult to find on land or in shallow coastal waters, the oil and gas industry has commenced exploration and development in deeper waters, miles from production and storage facilities. Prior to oil and gas being discovered in deep waters, the preferred method of producing the wells was to place the wellheads and the subsequent control devices for the wells at the sea surface on a platform. The access to these wells for the purpose of placing monitoring devices or performing intervention logging services was easily performed from the off-shore platform with the many well known methods of wireline logging, continuous coiled tubing, or even hydraulically pump down logging and monitoring systems.

Obtaining access to subsea wells for logging, monitoring or control purposes generally requires a costly submersible connection from the sea surface to the wellhead. Current methods, for example, to repair permanently disposed monitoring equipment, or to insert a suite of well logging tools into sub-sea wells, require the mobilization of a surface vessel which contains an off shore rig known to those in the industry as a semi-submersible rig or a drill ship. In all cases, the entry into the subsea well of the logging tools or tools to replace and dispose permanent monitoring equipment is performed through the production tubing. Because such wells are very expensive to drill and bring on line, most oil and gas producers prefer to not reenter the well unless absolutely necessary.

Hence, subsea wells are difficult to log or access for the placement of monitoring equipment. Further, visual inspections of these subsea wells are impossible because of the depths and distances of the wellhead from the nearest maintenance and production platform facility. Abnormal subsea well conditions cannot be observed in the manner of offshore platform wells or land wells, where pressure gauges and visual leak detection may be maintained.

Monitoring of the subsea wells for safety, reservoir evaluation, and environmental reasons requires the instrumentation monitoring of the subsea well to be done remotely. This requires the transmission of the data from subterranean sensors in the well and subsea monitoring sensors over large distances to a receiving and processing node. This transmission of data is normally done over copper or optic fiber transmission umbilicals connecting the sub-sea wells back to surface data receiving stations. Because of the long distances and depths, considerable expense must be incurred to utilize these subsea umbilicals.

Furthermore, the current monitoring methods to monitor subsea wells are further compromised by frequent failure of various subterranean gauges and instruments used to monitor oil and gas wells. Because of the remoteness of subsea wells from the surface of the sea and the need for rig interventions to access the subsea and subterranean monitoring devices, they require well maintenance to be performed from intervention rigs which are not always immediately available to perform such maintenance. The result of these failures and the difficulty of quickly repairing them generally results in the decision to continue producing deep-water wells without any subsea monitoring information for leaks and pressure anomalies and without subterranean monitoring of reservoir parameters. Such shortcuts are undesirable because they can lead to catastrophic failures of wells, hydrocarbon releases into the sea, and less than optimal reserve recovery.

The logging of wells has traditionally been done from platforms and on land wells to obtain additional information about a well's reservoir condition and the integrity of the well's structure. In subsea wells, logging is rarely done, as it requires the mobilization of very large and expensive semi-submersible rigs or drill ships. Furthermore, these subsea logging interventions introduce the possibility of losing wireline equipment in the well and compromising the well's ability to produce. Also, sub-sea logging operations normally require the production of the well be reduced or curtailed during process of rigging up of the logging equipment.

Because of the above-mentioned difficulties of logging and maintaining unreliable subterranean monitoring equipment and very long umbilical transmission lines, many sub-sea wells are produced while monitoring the produced fluid back at the process or storage facility many miles away. This monitoring does not yield any indication of where the fluids are coming from in the well (i.e. which portion of the formation may be producing) which may be desired where production may be resulting from large perforated intervals in the well. Additionally, flow rate information monitored at the surface does not identify possible cross flow of fluids between reservoir intervals, changes in water, oil, and gas quantities as function of the depth of the well, the presence of leaks in well tubular conduits, and whether the reservoir is depleting in pressure.

It is desirable from both a reservoir engineering perspective as well as from a safety and environmental perspective to obtain real-time information from subsea wells relating to dynamic subterranean environment, fluid production parameters, and subsea well equipment integrity. Examples of parameters which are desirable to monitor on a real-time basis are fluid flow rates, water cut, resistivity of subterranean formations, spontaneous potential of subterranean reservoirs, pressure, temperature, sand production, steel wall thickness of tubulars, seismic energy from the reservoir or other sources, and other variables known to those familiar with oil and gas production. This information is currently gathered from either permanently disposed monitoring devices attached to the production tubing or from well intervention methods that insert the devices concentrically through the production tubing in the subsea well.

The commonly disposed permanent monitoring devices include pressure sensors, flow meters, temperature sensors, geophones, accelerometers, seismic source broadcasters, and other sensors and instruments. These devices are inserted in subsea wells concentrically through the well's production tubing either using wireline, coiled tubing, and slickline, from a rig placed at the surface of the sea and connecting to the subsea well through the water by risers. Alternatively, these permanently disposed devices are inserted in a well with the production tubing. The production tubing is also inserted into the well via the use a rig on the surface of the sea where again a large riser is run from the sub-sea wellhead at the sea floor up through the water to the rig. Therefore, when permanently disposed monitoring equipment is inserted in a well either with production tubing or the other forms of insertion of the devices concentrically through the production tubing, a surface rig is required.

All of these parameters are obtained traditionally on land or offshore platform wells using offshore platform wells via the art of well logging. However, in the case of sub-sea wells the methods have to date not been developed to allow for safe, simple, and rapid log intervention into wells. Likewise, the retrieval of down hole pressure gauges or other instruments on land or off-shore platform wells is often achieved by a well intervention with commonly known methods of wire line operations thereby not requiring a rig to be mobilized to the land or off-shore platform location. Failure and need for retrieval of subterranean pressure gauges or other subterranean instruments in sub-sea wells can not be performed by wire line or logging interventions unless a semi-submersible rig or drill ship is deployed to the sub-sea well location. The present invention provides a rigless intervention method to access subsea wells.

Several subterranean data gathering systems are currently used to obtain data from the wells. This is commonly done using down hole permanent pressure gauges, and flow meters, that have long umbilical from the sub-sea well to a platform or floating production facility. The umbilical have electrical or optical cable to transmit data from the different permanently deployed instruments and devices in the well. The current method of gathering data from subsea wells practiced by the oil and gas industry requires the pressure gauges and pressure gauge electrical or optical data transmission line be disposed in the subsea well during the initial well construction, known to those familiar with the art as the well completions. It also requires that all down hole instruments be connected to data transmission lines, either electrical or optical lines, by a subsea wet connection. This connection then connects the subterranean data transmission lines to the subsea umbilical transmission lines. These connections are difficult to do at deep-water depths, which often have large currents, high hydrostatic pressures, and are at depths where only a very limited number of Remotely Operated Vehicles (ROVs) can operate and make such wet connections.

The deep-water wells are being placed further from land, platforms, or floating process facilities to which the umbilicals are connected. This results in very long umbilicals with large weights and costs. Therefore, each additional instrument data transmission requirement from the sub-sea well requires an additional line in the umbilical going from the sub-sea wellhead back to the host facility at the sea surface often many miles away.

When the pressure gauge fails or when the data transmission line fails, or when the data transmission's wet-mateable connection fails, the only recourse for repair of the data gathering system is an intervention into the well, using either a drill ship or a semi-submersible drilling rig resulting in the pulling of the well completion, and a significant number of days of lost production during the recompletion of the well, all as previously described.

The present invention provides a method and apparatus to intervene into these deepwater sub-sea wells without deploying a deepwater rig to hydraulically connect to the sub-sea wellhead and thereafter deploy logging instruments into the well has long been sought by the oil and gas industry. Another feature of the present invention permits the entry of sub-sea wells for the purpose of obtaining data without placing logging tools and wire line cable into the production tubing fluid flow stream of these sub-sea wells. The intrusion of logging tools into the flow stream of such wells presents a significant risk of losing the logging equipment in the well and obstructing fluid production. The present invention obviates the need for such interventions.

SUMMARY OF THE INVENTION

A new method of logging, monitoring and controlling sub-sea oil and gas wells is provided. This invention describes a method and apparatus to obtain continuous or periodic data (if desired) from reservoirs producing through sub-sea wells. This invention further describes the method and apparatus used to process, transmit, and archive said data into information for reservoir and well management. The present invention relates to a new method and apparatus for constructing sub-sea wells using an alternative path-conduit to connect the subterranean conduit to a submersible conduit proceeding from the wellhead to the surface of the sea.

The preferred embodiment of this invention consists of a dual conduit system with the dual conduits connected at the bottom in the well providing a U-connection at the ends of the dual conduit and the other ends proceeding through the well head terminating outside the well head in a pair of hydraulic wet connection devices. This then forms a continuous conduit starting at the sea floor near the sub-well down the well and then back up to the sub-sea surface outside the well terminating in the two sea floor hydraulic wet mate devices.

This invention further teaches the method of constructing a well by placing the alternative path conduits into one of the sub-sea wells casing conduits. This invention teaches the insertion of logging tools, instruments, wireline, optic fibers, electrical cable, and other tools and instruments through the inventions alternative path conduits. This alternative path tube is deployed in the well, proceeds upwards through the wellhead, sub-sea safety valves, through sub-sea hydraulic disconnects, and to the sea surface, where it can be accessed by surface service vessels which can deploy logging tools and other instruments into the alternative path. The invention further teaches the method of inserting permanent sub-sea and subterranean monitoring devices through the alternative path conduits of this invention.

This invention further teaches the connection of the alternative path conduits to a surface instrument pod by connecting continuous conduit from the conduit proceed forth from the sub sea well and wellhead terminating at the hydraulic wet connects, where the inventions surface instrument pod remains on station above the sub-sea well at the sea surface. The invention further teaches that the instrument pod can have recording, processing and transmission devices inside the pod where the devices record, processes, and transmits the data and information to receiving locations on land or offshore. The use of an umbilical connected back to a remote surface instrument pod from the alternative path conduit disposed in the sub-sea well avoids the need for long umbilical cables back along the sea floor to the host production facility miles from the sub sea well. An additional feature of this invention permits remote data transmission and well interaction. Commands can be transmitted from a remote station to the surface instrument pod, and then down the umbilical disposed in the sea, and into to the sub-sea well for the purpose of operating downhole devices, such as valves, gauges, sensors and the like in response to these remote commands.

DETAILED DESCRIPTION OF THE DRAWINGS

DETAILED DESCRIPTION OF THE PREFERRED EMBODIMENT

The Alternative Path Conduit

Figure 1:
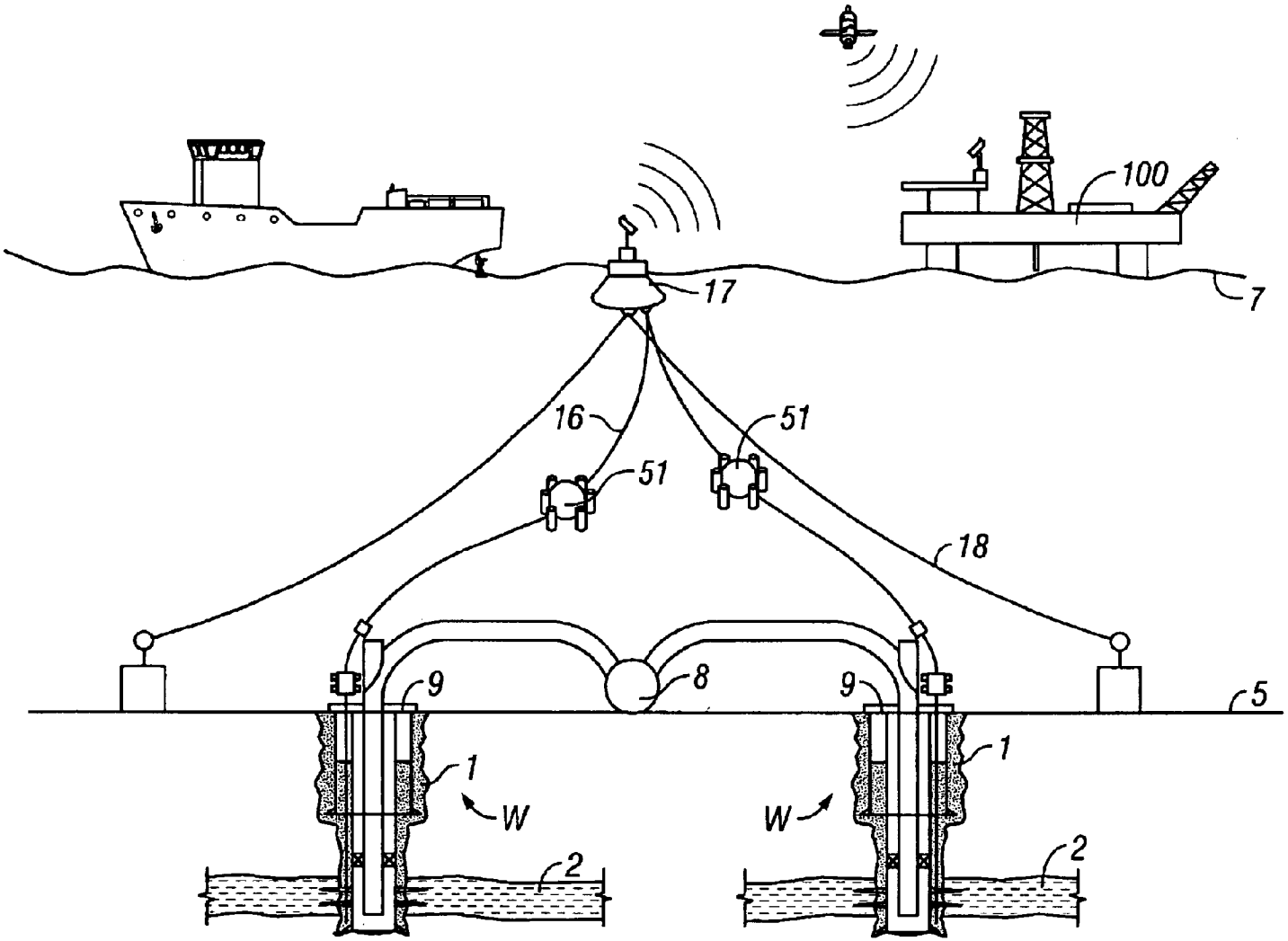
FIG. 1 is a partial schematic representation of the invention as disposed in several subsea wells.

Referring now to FIG. 1 of the drawings, a plurality of wells W are shown located on the sea floor 5. The well is drilled from the surface of the sea 7 using a semi-submersible 100 or drillship drilling rig (not shown). One or more wells W are bored by the action of rotating a drill bit on the end of a drill pipe from the surface rig where the drill bit is inserted inside of risers pipes and the drill cuttings are flushed out of the well bore with a drilling fluid using method and apparatus well known to those in the oil and gas industry.

Figure 2:
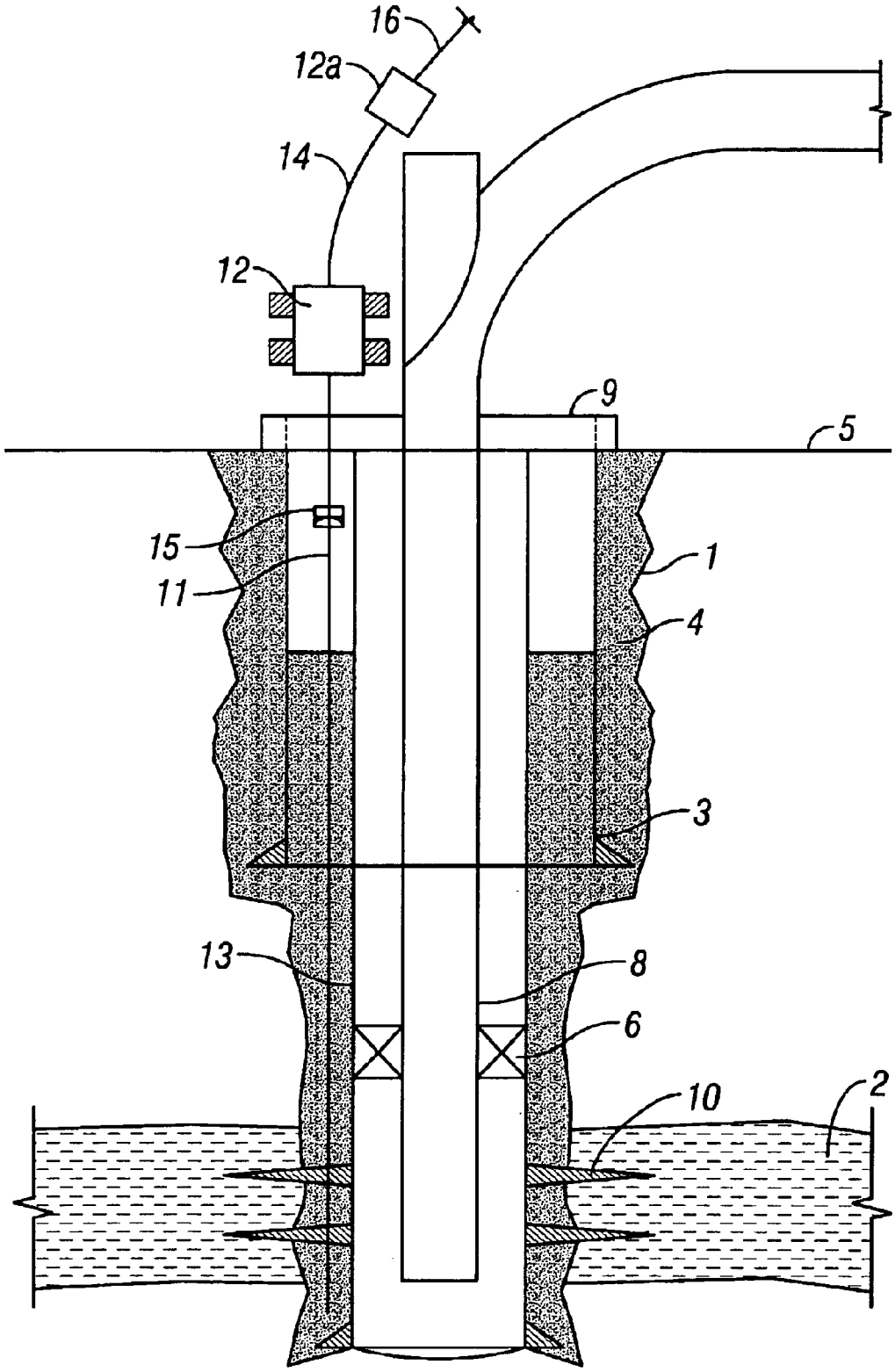
FIG. 2 is a cross-sectional schematic view of the invention showing the apparatus of the present invention disposed into a subsea well.

As more clearly shown in FIG. 2, a subsea well is constructed by drilling a borehole 1 down into the earth to intersect subterranean fluid production intervals 2 located in the earth. The well is constructed with at least one diameter of casing 3 disposed into the annulus of the borehole 1 and grouted into place from the surface rig, using cement 4 placed between the annular space formed between the bore hole 1 and casing 3. This process can be repeated with at least one additional casing 13. The final casing, in this figure casing 13, is explosively penetrated using explosive charges forming perforation tunnels 10 connecting the borehole hydraulically with the subterranean fluids in the earth. A production tubing string 8 is inserted inside the casing 13 and deployed from a surface rig. The production tubing 8 can provide adjacent its lower end, a sealing element known as a packer 6. The packer 6 is inserted in the annulus of casing 13 with the production tubing and set in the casing 13 above the perforation tunnels 10 to form a seal between the production tubing 8 and the casing 13 using any of the methods known to those familiar with oil and gas well completion technology. The upper end of the production tubing 8 is terminated and retained in a wellhead 9 forming a sealed hydraulic conduit between the production tubing and the casing with hydraulic communication with the reservoir or production zone 2 through the perforations 10.

Preferred embodiments of the present invention include the insertion of at least one parallel tubing string 11 of a smaller diameter disposed parallel, but exterior, to the production string 8, forming an alternative path through the well head and into the well.

In one preferred embodiment, the parallel tubing string 11 is connected to the outer diameter of casing 13 and inserted in the well from the surface rig while the casing 13 is deployed into the annulus of the wellbore 1. In another embodiment, a parallel tubing string (not shown) may be attached to the production tubing 8 and inserted into the well as the production tubing 8 is deployed from the surface rig. In either embodiment, the parallel tubing string 11 is connected through the wellhead 9 and sealed therein forming a sealed alternative path conduit into the sub-sea well without communication with the production fluid from the production interval 2. In both embodiments, at least one parallel path-tubing conduit 14 is connected above the wellhead 9 to a hydraulic quick connection 12. This connection can be made either at the wellhead or several hundred feet away from the wellhead to avoid the possibility of ROV collisions with the wellhead structure.

Figure 3:
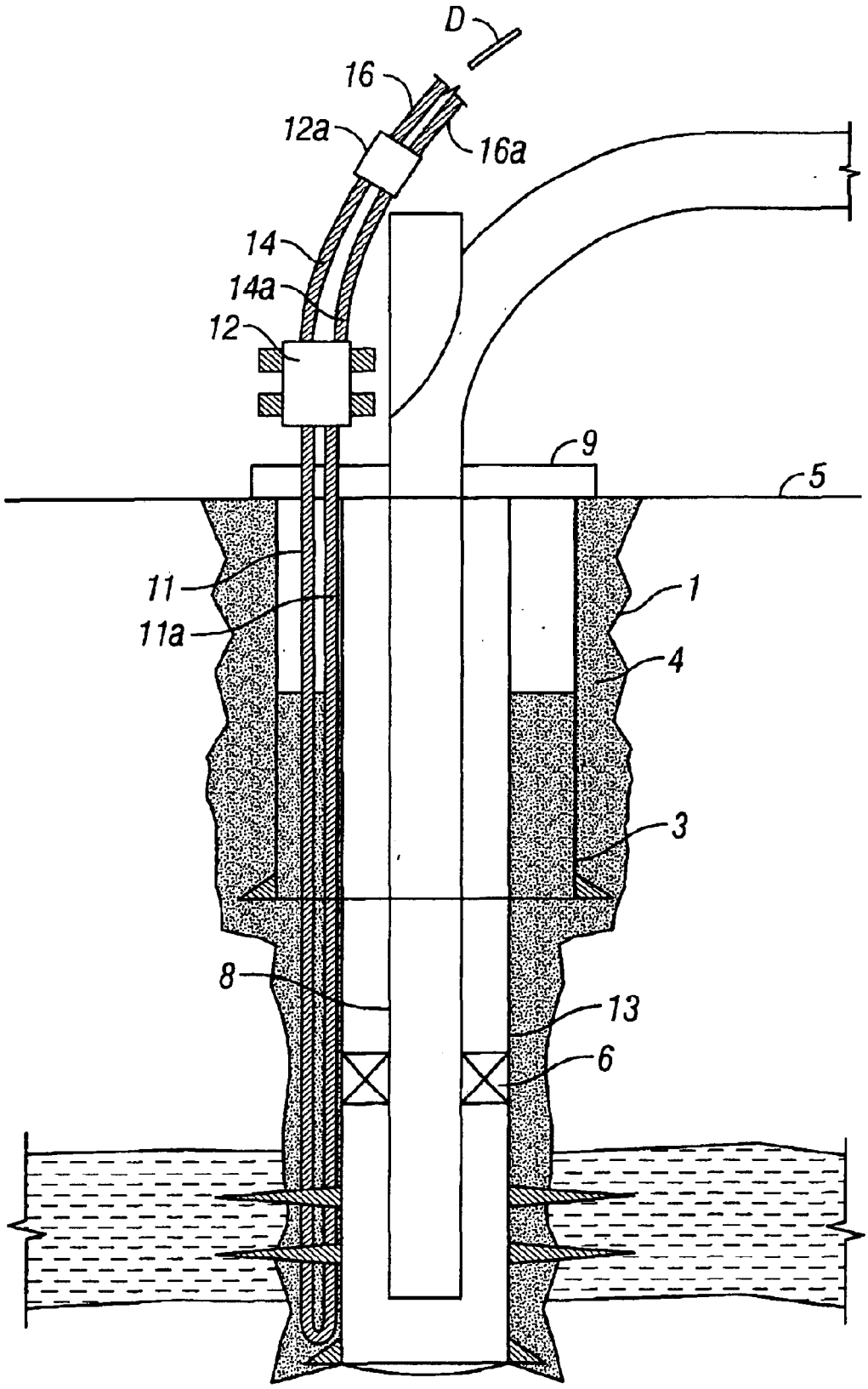
FIG. 3 is a partial schematic view of a U-connection in a producing well.

In yet another embodiment more fully shown schematically in FIG. 3., the well is constructed with a parallel alternative conduit path formed by inserting two parallel conduits in the well attached at the bottom with a U-tube connection. These parallel conduits form an alternative path to the production tubing 8 that goes down the well and then back through the sub-sea wellhead 9, with each end hydraulically connected above the well head with a hydraulic disconnect device 12. Each parallel conduit string 11 in each embodiment can provide a fluid control safety valve 15 disposed either above or below the wellhead 9. As may be readily seen from FIG. 3, the return conduit need not be of the same internal diameter as the ingress conduit. The continuous path of 14 to 11 through the wellhead 9 communicates through the egress side 11*a* and conduit 16*a*. In each manner of installation, the fluid control safety valve 15 is used to control the unwanted escape of fluids through the alternative path conduit system. Other hydraulic check valves may be placed at 12*a* as need to prevent escape of fluids upon disconnection of the conduit during operations.

This invention further includes the construction of at least one continuous hydraulic conduit path from below the sub-sea floor 5 into and through the subsea wellhead 9 to the surface of the sea 7 by connecting alternative path conduit 14 above the well head proceeding from the well to a submersible conduit 16, such that one end of the continuous path has one end at the surface of the sea 7. Referring back to FIG. 1, conduit 16 can be partially supported by subsurface buoys 51.

Referring still to FIG. 1, the present invention further includes the connection of the submersible conduit 16 from the subsea wellhead 9 to a surface instrument pod 17. This surface instrument pod can be moored to the sea floor by a system of cables and anchors 18 to keep instrument pod 17 on station above the subsea wells. Alternatively, instrument pod 17 can be tethered by a single line providing resilient means to hold the pod in a set position while permitting the pod to move with the movement of the waves. So far as is known to applicant, no alternative path subsea conduit path has ever been used to provide a means of communicating with or controlling a subsea producing well.

Installation of the Alternative Path Pod and Lines

The present invention requires that the alternative path conduit be installed during completion of the well. Consequently, the installation of the alternative path conduit must be coordinated with the setting and grouting of the well structure. Accordingly, the well profile must be planned with the alternative path conduit. If the alternative path conduit is to provide a path for optic fiber cabling only, a ¼ inch tubing or similar can be installed and strapped to the final casing upon setting of the casing string from the drilling platform or ship. If the alternative path conduit is to provide a means for wireline logging tools, chemical injection lines or hydraulic control lines, larger diameter conduit can be used to permit subsequent use as a combination pathway for one or more of these methods. If the preferred U-shaped alternative path conduit is set in the completed well, a memory-tool (i.e. one having a means of sensing and preserve the information as it passes through the pipe at a fixed velocity) may also be pumped into and out of the well to log the well without any wireline connection. Since the alternative path conduit is set in the wellhead of each subsea well, the wellhead must be designed for the alternative path conduit as well. Once set in the wellhead, the alternative path conduit provides a useful and easy diagnostic tool for monitoring, controlling and logging the well. The casing and wellhead are set in a manner well known to those in the industry. The connection of the alternative path conduit to the wetmate connection may be made either at the surface and installed with the wellhead or installed later. It is anticipated that most installations will be made after the installation of the wellhead is accomplished and flanged up on the sea floor.

For installation, instrument pod 17 is connected to conduit 16 aboard a surface vessel, like a semi-submersible drilling rig, or other vessel that allows for the connection of the conduit 16 aboard the vessel having the same relative motion as the instrument pod 17 and the conduit 16 proceeding up from the sub sea well. The preferred embodiment disposes one or more instrument packages within the instrument pod 17 that permit the gathering of data coming various data transmission lines disposed inside the alternative path conduit 16 proceeding up from the well. These data lines are any of the well-known lines that are used for data transmission including but not limited to optical fiber, electrical conductors, and hydraulic fluids. The optical fiber can be connected to a light source. The electrical conductor can be connected to a logging system. In the case of hydraulic fluids, a pressure monitoring system can be connected to the conduit.

Optical Fiber in the Alternative Path Conduit

Optical fibers may be inserted in the alternative path conduit by connecting a pump to the provided port on the instrument pod 17. Silicon gel or another fluid can be pumped into the annulus of the alternative path conduit and fiber optic cabling is fed into the pumping silicon gel (or other fluid) which carries the line into the well bore due to the frictional force of the silicon (or other fluid) against the fiber optic line. Upon reaching total depth, the pumped fiber is fully deployed in the wellbore. Fluids that may be used for deployment include liquids such as water as well as gases such as air or nitrogen.

If the alternative path conduit has been connected with a U-connection within the wellbore, the fiber optic cabling will be transported through the tubing and either egress the well at the wellhead or be transported back to the instrument pod by the pumping. The disposition of the optic fiber in the wellbore permits the instrument pod 17 to sense with the use of the optical time domain reflectometry apparatus described in U.S. Pat. No. 5,592,282 to Hartog which is incorporated herein by reference and made a part hereof for all purposes, the thermal profile (distributed temperature measurement) of each well into which the line is disposed providing inflow conformance. The disposed fiber optic line also permits monitoring of production or well conduit integrity thereby permitting detection of leaks in the casing or production string. The fiber optic line also permits the monitoring of gas lift valves from the thermal profile of the well.

In other embodiments, the fiber optic line may include one or multiple sensors or sensor locations. The sensors or sensor locations are adapted to measure a parameter of interest, such as temperature, distributed temperature, pressure, acoustic energy, electric current, magnetic field, electric field, flow, chemical properties, or a combination thereof. The sensors may be fiber optic sensors, electrical sensors, or other types.

Further, the alternative path conduit can be used to pump both multi-mode and single mode optic fiber into the same well bore thereby permitting calibration and correlation of backscattering signals to improve the resolution of the optical time domain reflectometry analysis of deep subsea wells.

In an alternative embodiment, an electrical cable can be disposed in the alternative path conduit instead of the optical fiber. The electrical cable may include one or more sensors or sensor locations, as in the case of the optical fiber. The optical fiber and the electrical cable are generally referred to herein as a "cable."

Electrical Conductor in the Alternative Path Conduit

Well logging is often accomplished by disposing a tool down a wellbore with a variety of tools located thereon. These tools may be inserted into the well bore, adjacent the production flow line, and therefore never risk causing obstruction or damage to these very expensive deep water well projects. Any cased hole logging tool can be disposed and run from a tubular member adjacent the production tubing. These include, without limitation, neutron decay detector scanning, gamma ray logging, magnetic resonance logging, seismic sensing, and the like. For example, referring now to FIG. 3, if conduit 16 was 2 inches in diameter, normal well logging tools could be easily inserted in the well bore to the full extent of the well bore. These tools could be easily pumped down the annulus of conduit 16 through wellhead 9 and into the larger diameter side of the U-shaped subsea conduit 11. The logging techniques could be accomplished from the buoy, or the tools could be permanently deployed to allow all varieties of common logging techniques to be accomplished with the deployed tools. These tools could be inserted to the total well depth either from the moon pool of the drilling rig as it completes the well or from the instrument pod 17 after placement on the deck of a service vessel.

Operation of the Alternative Path Pod and Lines

The alternative path conduit and instrument pod allows an extension of the wellhead to the sea surface for control, logging and sampling lines. The instrument buoy would be deployed after connection with the submersible conduit from a regular buoy tender vessel. Since the buoy is much closer to the subsea wellhead than the remote production platform, control lines may be easily used to log well inflow conformance by real-time temperature profiles. If more than one well in a field is provided with the alternative path conduit and buoy system, a real time reservoir profile may be developed by combining the information received from each alternative path instrument pod. This information may be transferred from each instrument pod to either a production platform or land based radio station and processed and provided over modern communication channels to knowledge workers interested in well production and characteristics.

The instrument pod may also be used as a staging area for remotely activated well shutoff controls which would shut-in a well as required by reservoir engineers for the reasons well known to those having skill in this industry. A command could be issued to the instrument pod which would thereafter executed either an acoustic, electrical, or photonic signal to a subsurface valve to shut in the well.

Service and Repair of the Alternative Path Pod and Lines

Service of the alternative path pod and lines can be readily accomplished from regular surface vessels and remotely operated subsea vehicles (ROVs) presently used to service subsea wells. As required, the service vessel would be called to service each buoy with fuel (if required to run generators), glycol or other chemicals (if need to pump into the well zone), or replace or service cabling or conduit run into the alternative path. The pod would be lifted onto the work vessel by crane or other lifting means. The rise and fall of the vessel would not prevent the servicing of the conduit. A pump would be connected to the conduit and the optic fiber line could be washed from the conduit. Alternatively, new lines may be inserted into the alternative path conduit by pumping in a manner well known to those providing current well service.

Since the conduit is continuous from the surface into the well bore and back to the surface in the preferred embodiment. The introduction of cabling, or conductors into the well bore can be enhanced by filing the conduit with a low-density hydraulic medium, such as nitrogen gas, and then pumping in the lines one side while bleeding off the gas from the other side of the continuous looped circuit.

It is noted that the alternative path conduit, through its different methods of communication as previously disclosed (such as optical fiber, electrical cable, and hydraulic fluid) can act as a means to send commands from the pod to devices located in the wellbore. For instance, a command to set the packer 6 may be sent from a remote location to the pod and from the pod down the alternative path conduit to the packer. Provided the command sent is the "set packer" command, the packer is then set. Besides a packer, devices that can be controlled include but are not limited to valves (such as flow control valves), perforating guns, and tubing hangers.

The preceding are examples of deploying permanent or temporary monitoring devices D within the alternative path conduit, including the deployment of cables, logging tools, memory tools, seismic arrays, and sensors. FIG. 3 schematically illustrates a device D being deployed within the alternative path conduit.

While particular embodiments of the invention have been described herein, this application is not limited thereto. It is intended that the invention be as broad in scope as the art may allow and that the specification and claims be interpreted as accordingly.

What is claimed:

1. A subsea well construction, comprising a casing string disposed in a subsea well;

a production string disposed in the casing string;

an alternative path conduit disposed exterior to the casing string;

the alternative path conduit passing through a subsea wellhead; and at least one sensor comprising an optical fiber deployed in the alternative path conduit, the at least one sensor adapted to measure a parameter of interest.

2. The construction of claim 1, wherein the alternative path conduit is proximate to the casing string.

3. The construction of claim 1, wherein the alternative path conduit is cemented in place.

4. The construction of claim 1, wherein the parameter of interest is one of temperature, distributed temperature, pressure, distributed pressure, acoustic energy, electric current, magnetic field, electric field, flow, chemical properties, or a combination thereof.

5. The construction of claim 1, wherein the optical fiber is deployed in the alternative path conduit by use of frictional fluid force.

6. The construction of claim 1, wherein the at least one sensor comprises a distributed temperature sensor of which the optical fiber is a part thereof.

7. The construction of claim 6, wherein the distributed temperature sensor measures the thermal profile of at least part of the subsea well.

8. The construction of claim 7, wherein the distributed temperature sensor utilizes optical time domain reflectometry to measure the thermal profile.

9. The construction of claim 7, wherein the thermal profile is used for one of providing inflow conformance, monitoring well production, monitoring well integrity, detecting leaks in the casing string or production tubing, or monitoring of gas lift valves.

10. The construction of claim 1, wherein the optical fiber is used for one of providing inflow conformance, monitoring well production, monitoring well integrity, detecting leaks in the casing string or production tubing, or monitoring of gas lift valves.

11. The construction of claim 1, wherein the at least one sensor comprises at least two optical fibers.

12. The construction of claim 11, wherein the at least two optical fibers comprise a multimode optical fiber and a single mode optical fiber.

13. The construction of claim 1, wherein the at least one sensor is an electrical sensor.

14. A subsea well construction, comprising:

a casing string disposed in a subsea well;

a production string disposed in the casing string;

an alternative path conduit disposed exterior to the casing string;

the alternative path conduit passing through a subsea wellhead; and at least one sensor deployed in the alternative path conduit, the at least one sensor adapted to measure a parameter of interest, wherein the at least one sensor is included on an optical fiber disposed in the alternative path conduit.

15. A subsea well construction, comprising:

a casing string disposed in a subsea well;

a production string disposed in the casing string;

an alternative path conduit disposed exterior to the casing string;

the alternative path conduit passing through a subsea wellhead; and at least one sensor deployed in the alternative path conduit, the at least one sensor adapted to measure a parameter of interest, wherein the at least one sensor is a fiber optic sensor.

16. A subsea well construction, comprising:

a casing string disposed in a subsea well;

a production string disposed in the casing string;

an a alternative path conduit disposed exterior to the casing string;

the alternative path conduit passing through a subsea wellhead; and at least one sensor deployed in the alternative path conduit, the at least one sensor adapted to measure a parameter of interest; and wherein the alternative path conduit has a u-shape.

17. A method to obtain information from a subsea well, comprising:

deploying a casing string in a subsea well;

disposing a production string in the casing string;

locating an alternative path conduit exterior to the casing string;

passing the alternative path conduit through a subsea wellhead;

deploying at least one sensor comprising and optical fiber in the alternative path conduit; and measuring a parameter of interest with the at least one sensor.

18. The method of claim 17, wherein the locating step comprises locating the alternative path conduit proximate to the casing string.

19. The method of claim 17, further comprising cementing the alternative path conduit in place.

20. The method of claim 17, wherein the parameter of interest is one of temperature, distributed temperature, pressure, distributed pressure, acoustic energy, electric current, magnetic field, electric field, flow, chemical properties, or a combination thereof.

21. The method of claim 17, wherein the deploying at least one sensor step comprises deployed the optical fiber in the alternative path conduit by use of frictional fluid force.

22. The method of claim 17, wherein the at least one sensor comprises a distributed temperature sensor of which the optical fiber is a part thereof.

23. The method of claim 22, wherein the measuring step comprise measuring the thermal profile of at least part of the subsea well by use of the distributed temperature sensor.

24. The method of claim 23, wherein the measuring stop comprises utilizing optical tune domain reflectometry to measure the thermal profile.

25. The method of claim 23, wherein the thermal profile is used for one of providing inflow conformance, monitoring well production, monitoring well integrity, detecting leaks in the casing string or production tubing, or monitoring of gas lift valves.

26. The method of claim 17, wherein the optical fiber is used for one of providing inflow conformance, monitoring well production, monitoring well integrity, detecting leaks in the casing string or production tubing, or monitoring of gas lift valves.

27. The method of claim 17, wherein the at least one sensor comprise at least two optical fiber.

28. The method of claim 27, wherein the at least two optical fibers comprise a multimode optical fiber and a single mode optical fiber.

29. A method to obtain information from a subsea well, comprising:

deploying a casing string in a subsea well;

disposing a production string in the casing string;

locating an alternative path conduit exterior to the casing string;

passing the alternative path conduit through a subsea wellhead;

deploying at least one sensor in the alternative path conduit, wherein the at least one sensor is included on an optical fiber disposed in the alternative path conduit; and measuring a parameter of interest with the at least one sensor.

30. A method to obtain information from a subsea well, comprising:

deploying a casing string in a subsea well;

disposing a production string in the casing string;

locating an alternative path conduit exterior to the casing string;

passing the alterative path conduit through a subsea wellhead;

deploying at least one fiber optic sensor in the alternative path conduit; and measuring a parameter of interest with the at least one sensor.

31. The method of claim 17, wherein the at least one sensor is an electrical sensor.

32. A method to obtain information from a subsea well, comprising:

deploying a casing string in a subsea well;

disposing a production string in the casing string;

locating an alternative path conduit exterior to the casing string, wherein the alternative path conduit has a u-shape;

passing the alternative path conduit through a subsea wellhead;

deploying at least one sensor in the alternative path conduit; and measuring a parameter of interest with the at least one sensor.

* * * * *